US005135310A

United States Patent [19]

Nodus et al.

[11] Patent Number: 5,135,310

[45] Date of Patent: Aug. 4, 1992

[54] MIXING EQUIPMENT ESPECIALLY FOR MANUFACTURING STARCH ADHESIVE

[75] Inventors: Charles J. Nodus; Steven C. Petrila; Robert F. Lantz, III, all of Chicago, Ill.

[73] Assignee: The Ringwood Company, Chicago, Ill.

[21] Appl. No.: 323,184

[22] Filed: Mar. 13, 1989

Related U.S. Application Data

[63] Continuation of Ser. No. 50,541, May 14, 1987, abandoned.

[51] Int. Cl.[5] ..... B01F 7/04; B01F 7/00

[52] U.S. Cl. ..... 366/297; 366/301; 366/328; 366/329; 241/292.1; 422/108; 422/127

[58] Field of Search ..... 366/64, 66, 244, 245, 366/264, 279, 292-302, 304, 96, 168, 171, 172, 303, 318-322, 324, 328, 329, 330; 106/213; 127/23, 70, 71; 422/134, 135, 137, 225, 226, 227, 229, 108, 259, 127, 286, 287, 901; 241/101 B, 292.1, 282.1, 282.2

[56] References Cited

U.S. PATENT DOCUMENTS

| | | | |
|---|---|---|---|
| 61,494 | 1/1867 | Westover | 366/329 |
| 1,762,950 | 6/1930 | Beers | 366/302 |
| 1,916,192 | 4/1933 | David | 241/292.1 |
| 2,333,565 | 11/1943 | Hawk | 366/291 |
| 2,389,545 | 11/1945 | Pointon | 366/297 |
| 2,864,421 | 12/1958 | Schmidt | 241/292.1 |
| 3,042,264 | 7/1962 | Trumbull | 366/300 |
| 3,244,410 | 4/1966 | Myers | 416/122 |
| 3,524,730 | 8/1970 | Yokouchi | 366/300 |
| 3,532,327 | 10/1970 | Landberg | 366/302 |
| 3,600,328 | 8/1971 | Lieffers | 366/291 |
| 3,606,577 | 9/1971 | Conn | 416/181 |
| 3,622,388 | 11/1971 | Larson | 106/213 |
| 3,630,636 | 12/1971 | Hill | 416/181 |
| 3,638,920 | 2/1972 | Davis | 366/299 |
| 3,746,267 | 7/1973 | Myers | 366/299 |
| 3,790,138 | 2/1974 | Neier | 366/298 |
| 3,797,807 | 3/1974 | Behrens | 366/298 |
| 3,941,357 | 3/1976 | Wurtz | 366/291 |
| 4,279,658 | 7/1981 | Harvey et al. | 106/213 |
| 4,298,289 | 11/1981 | Walley | 366/603 |
| 4,462,693 | 7/1984 | Buschbom et al. | 366/297 |
| 4,501,047 | 2/1985 | Wrassman | 241/292.1 |
| 4,555,061 | 11/1985 | Linde | 241/292.1 |
| 4,760,967 | 8/1988 | Bendickson | 241/292.1 |
| 4,801,433 | 1/1989 | Yamanaka et al. | 366/299 |

FOREIGN PATENT DOCUMENTS

| | | | |
|---|---|---|---|
| 645301 | 7/1964 | Belgium | 366/299 |
| 799528 | 6/1936 | France | 241/292.1 |
| 671832 | 7/1979 | U.S.S.R. | 366/279 |
| 179913 | 7/1923 | United Kingdom | 366/300 |
| 467431 | 3/1975 | United Kingdom | 366/297 |

*Primary Examiner*—Harvey C. Hornsby
*Attorney, Agent, or Firm*—Laff, Whitesel, Conte & Saret

[57] ABSTRACT

A starch based adhesive is made in an agitator tank which has a first rotatable propeller shaft with a plurality of propellers distributed along the length thereof. Each of at least some of the propellers is surrounded by an apertured shroud, which could be made of expanded metal or the like, for example. Above the propeller shaft is a second rotatable shaft having a plurality of high speed shearing blades affixed thereon. The two shafts are preferably driven by separate motors, the shearing blades being driven by a motor having approximately 4-5 times the power of the motor driving the propeller shaft in order to impart a comparably larger amount of energy to the slurry via the shearing blades as compared to the energy imparted by the propellers.

6 Claims, 4 Drawing Sheets

MIXING EQUIPMENT ESPECIALLY FOR MANUFACTURING STARCH ADHESIVE

This application is a continuation of application Ser. No. 07/050,541, filed May 14, 1987, now abandoned.

This invention relates to high speed equipment for mixing and shearing any of various liquids and semi-liquids and more particularly——although not exclusively——to machines for making starch adhesives, especially adhesives used in the manufacture of corrugated board, such as paperboard, for example.

The present invention relates to an improvement over the agitator tank shown in U.S. Pat. No. 3,622,388 (Larson) for making a starch adhesive. In particular, Larson provides an agitator tank which mixes and shears a starch material during a process of manufacturing adhesives. The Larson agitator tank runs at what was heretofore considered to be a high, but controlled, speed. The equipment was designed for use with a corrugated board making machine which produced up to 700 feet per minute, which was high speed for its day. However, at the present, corrugated board making machines run much faster.

In general, Larson describes a process wherein two components of starch are mixed within the agitator tank. One component, called a "carrier", is a gelatinized starch before it is charged into the tank. The other component is a raw (ungelatinized) starch. The carrier acts as a suspending agent for the raw starch. These two components are charged into the agitator tank where they are mixed with water.

It is important for the mixing equipment to impart a sufficient amount of energy to the two components while they are being mixed in order to break the starch bonding, to prevent clumping, and otherwise to insure a proper mixture before the hardening of the adhesive begins. During the shearing and mixing within the agitator tank, the raw starch swells and gelatinizes to provide an adhesive having a substantial bonding strength. While the Larson agitation created a slurry with a prescribed viscosity, great care had to be exercised to prevent an over-gelatinization. As a result, Larson's agitator tank is no longer adequate to provide an adhesive at a rate which enables these modern machines to run at their full speed.

In the Larson system, the properties of the gelatinized carrier were critical and had to be closely controlled. The corresponding characteristics of the adhesive made in the inventive equipment are, relatively speaking, noncritical. Therefore, as compared to the Larson system, the inventive gelatinizing process hardly requires any close control. The invention gives a smaller starch particle size. The inventive equipment provides adhesives having a higher percentage of solid particles as compared to the percentage of solid particles provided by the prior art equipment. As compared to the prior art, the inventive adhesive has a much greater penetration and absorption power, when it is deposited on the corrugated board. These are great advantages.

When the inventive agitator tank was operated at the ultra high speeds of its design, it was found that not only was the end product adhesive manufactured faster, but also that it unexpectedly had superior characteristics which are not found in the prior art. For example, over a relatively long period of time, the mixed adhesive has no tendency to separate by settling, whereas the Larson adhesive began almost at once to settle and within a few hours would become totally useless unless special precautions were taken.

To preclude settling the prior art adhesive required "enhancers" to stabilize viscosity. These enhancers added both cost and delay to the manufacturing steps. Since the adhesive made by the inventive device does not settle, it requires no enhancers; therefore, it costs less and reduces manufacturing time.

It is thought that the invention imparts both physical and chemical changes to the starting material which changes are not imparted to the starting material by the prior art agitator tanks. However, at this time, those changes are not fully and completely understood.

Accordingly, an object of the invention is to provide new and improved agitation tanks, especially well-suited for making starch adhesives.

Another object of the invention is to provide high speed adhesive mixing and shearing devices which serve the needs of high speed corrugated board making machines.

Yet another object of the invention is to provide a superior starch adhesive with greater penetration and bonding properties. Here, an object is to provide adhesives with a higher solids content and with smaller particle or granule size. Further an object is to provide starch adhesives which more stably retain their viscosity over longer periods of time.

Still another object is to decrease the batch preparation time.

A still further object is to provide a starch preparation system which stabilizes viscosity over an extended storage time, with or without special additives or carrier enhancers.

In keeping with an aspect of the invention, these and other objects are accomplished by providing a tank having a first rotatable propeller shaft with a plurality of propellers distributed along the length thereof. Each of at least some of the propellers is surrounded by an apertured shroud, which could be made of expanded metal or the like, for example. Above the propeller shaft is a second rotatable shaft having a plurality of high speed shearing blades affixed thereon. The two shafts are preferably driven by separate motors, the shearing blades being driven by a motor having approximately 4–5 times the power of the motor driving the propeller shaft in order to impart a comparably larger amount of energy to the slurry via the shearing blades as compared to the energy imparted by the propellers.

Viscosity breakdown of starch adhesive has been a chronic problem in the corrugated industry for many years. In addition, starch preparation has been a labor intensive process requiring in some instances three full-time workmen in the average corrugated box plant.

It can be shown that conventional starch systems produce an adhesive that breaks down asymptotically when viscosity is compared to time. This is due to mechanical shear introduced over time through circulating pumps, transfer pumps, storage tank agitators, etc.

The theory behind the inventive high shear system is that an adhesive is prepared initially with a much higher viscosity than is actually desired. Excessive mechanical shear is used to quickly break down the adhesive to a point where it is stable and usable over an extended period of time.

In one embodiment, the following results were found.

Adhesive Results (Over 3 Week Period)

A. Stable Gel Points Measured Daily:

D.B. 148° F.±1° F.
S.F. 148° F.±1° F.

B. Stable Viscosity Measured In Storage Tank Each Afternoon:
D.B. 44 Sec. - Steinhall±1 Sec.
S.F. 33±1 Sec.

The embodiment made up to seven batches of (5,180 Gallons) starch adhesive, with no special carrier starches, during a standard eight hour shift, with ample time for breaks.

The prepared starch adhesive has shown substantially no loss of viscosity while in the storage tank, even when stored over a three day weekend. The adhesive prepared in the inventive system gives better fiber pull and pin adhesion without increasing the prior art starch consumption, which is currently running at about 1.7 pounds per thousand square feet, or better. This has also been achieved without adding any additional workmen.

In summary, the inventive high shear system has produced a starch adhesive with little or no viscosity breakdown, better adhesive qualities capable of high solids formulation, and reduced batch times by up to 40%.

Preferred embodiments of the invention are shown in the attached drawings, wherein.

Figure 1:
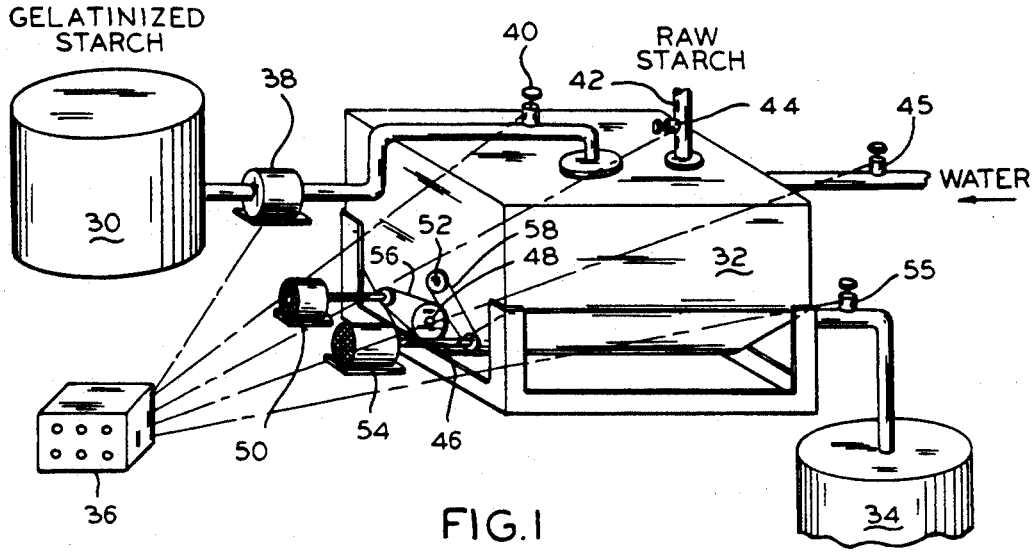
FIG. 1 is a perspective view schematically showing the inventive system for making starch adhesive.

FIG. 1 schematically shows a system, incorporating the invention, for making a starch adhesive. The system includes a source tank 30 of a gelatinized starch carrier, an agitator tank 32, an adhesive storage tank 34, and a control cabinet 36. The source tank 30 of the gelatinized starch carrier includes any suitable means for storing a batch of starch which is gelatinized, as by cooking, for example. After cooking, the starch has become gelatinized and is pumped into the agitator tank 32 responsive to an operation of any suitable pump 38. A valve 40 may be opened or closed to control the admission of gelatinized starch into the agitator tank 32. In one embodiment, tank 32 held 800-gallons.

A batch of raw starch is admitted into the agitator tank 32 from any suitable source, via a pipe or chute 42, and under the control of any suitable valve 44, or the like. The starting material may be any suitable starch; however, one preferred source is corn starch. Water is introduced into tank 32 through a pipe controlled by a valve 45.

Figure 14:
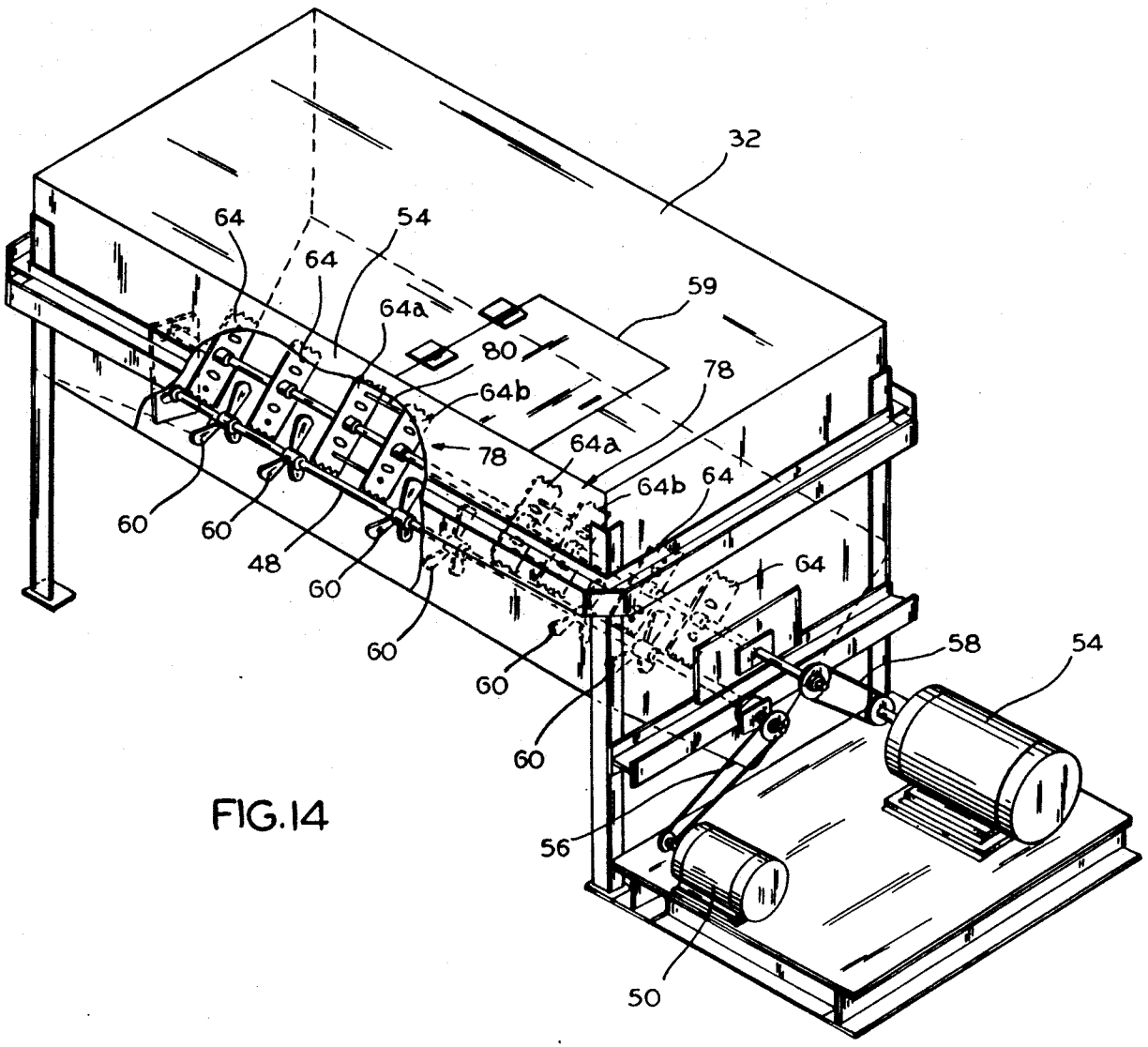
FIG. 14 is a perspective view of the inventive agitator tank, propeller, and shear assemblies.

The agitator tank 32 has a somewhat V-bottom 46 (FIG. 3) so that solids tend to collect in a given horizontal area of the bottom of the tank. (The term V-bottom is intended to also cover a somewhat U-shape, or similar shape into which solids may tend to settle). A propeller shaft 48 extends through the V-bottom, at the horizontal location where solids tend to settle and collect. The propeller shaft 48 is turned by a motor 50. A shearing blade shaft 52 extends horizontally through the tank at an elevation which is slightly higher than and spaced parallel to the propeller shaft. As best seen in FIG. 14, the propellers and shear blades are partially overlapped and are interleaved so that each propeller and its individually associated confronting shear blade drive the mixture into each other.

In the preferred embodiment, the propeller shafts turn at 500 RPM and the shear blade shaft at 800 RPM. The shaft 52 and its shear blades are driven by a separate motor 54. In one embodiment, the motor 50 driving the propeller shaft had 15-horsepower, 1800 RPM, while the motor 54 driving the shear blade shaft 52 had 50-horsepower, 1800 RPM, which indicates the relative amounts of energy imparted into the mixture from the two shafts.

After the batch of raw starch and carrier is suitably mixed, it is drawn off and into a storage tank 34 via a valve 55.

The entire system may be controlled from control cabinet 36 of any suitable design. For example, it may include a microprocessor which is programmed to introduce all of the materials into the agitator tank 32 and to operate the equipment on a suitable basis, which may be either timed or controlled by sensors. If a microprocessor is programmed to respond to signals feedback from suitable sensors, they may detect such things as temperature, viscosity, and the like. These and other parameters and specifications may be established by the manufacturer of the adhesive.

Figure 2:
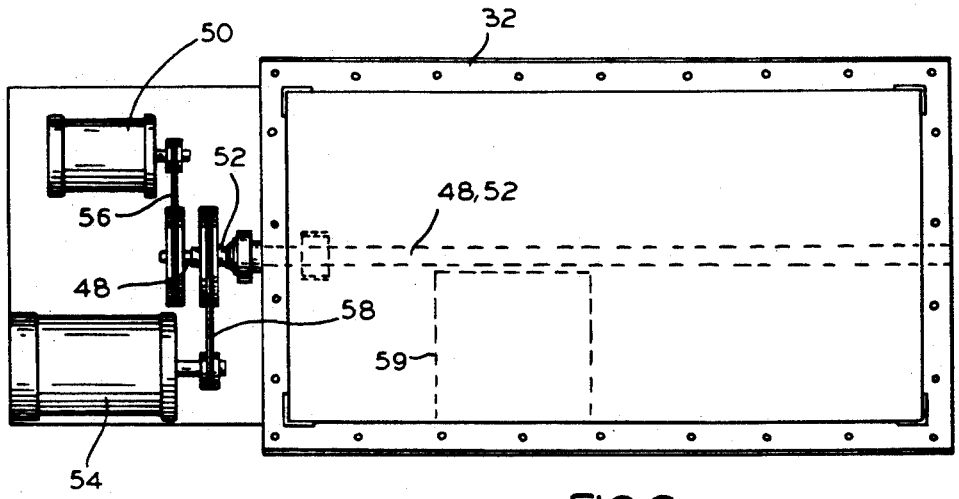
FIG. 2 is a plan view showing the top of the inventive agitator tank.
Figure 3:
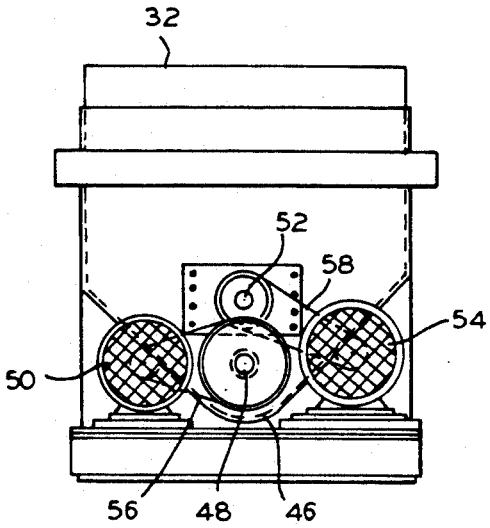
FIG. 3 is an elevation of the end of the inventive agitator tank.
Figure 4:
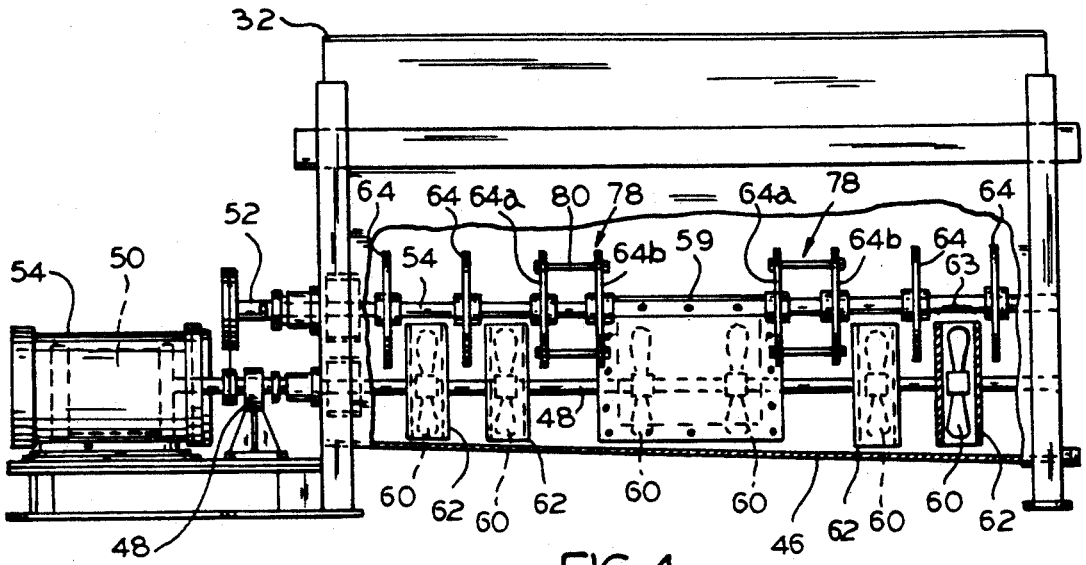
FIG. 4 is a side elevation of the agitator tank, partially broken away to show propellers and high shear blades within the tank.

FIGS. 2–4 show the exterior of the agitator tank 32, the motor 50 for driving the propeller shaft 48, and motor 54 for driving the shaft 52 carrying the high shear blades. The energy of the motors is transferred to the respective shafts via belts 56, 58 and associated pulleys. A door giving access to the interior of the tank is shown at 59.

The propeller shaft 48 (FIG. 4) has a plurality of propellers 60 (here six propellers) fixed thereon to turn therewith. The propellers 60 on one end (such as the left) of the shaft 48 are pitched to drive the mixture in one direction (say a left-hand pitch) and those on the other end of the shaft 48 are pitched oppositely (right-hand pitch). In one embodiment, each propeller is about 15-inches in diameter. A three blade propeller is preferred, as shown in FIG. 14; however, any suitable number of blades may be used, as exemplified by the two blade propellers of FIGS. 5, 12.

Figure 5:
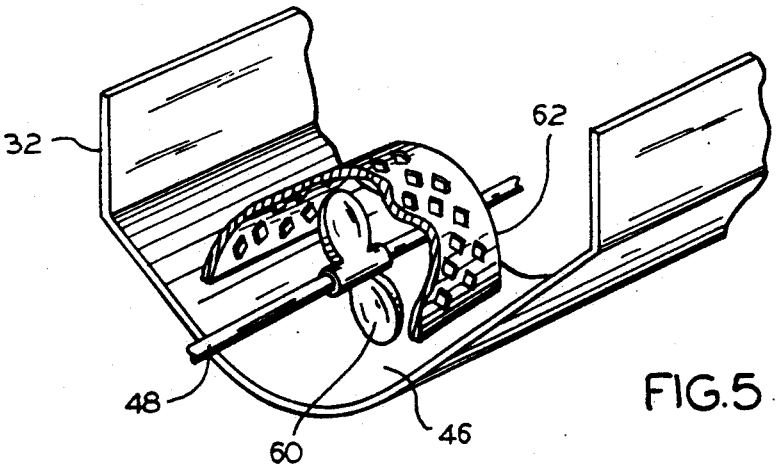
FIG. 5 is a perspective view of a fragment of the agitator tank showing a propeller within an apertured shroud.

At least some of the propellers 60 are enclosed in individually associated, preferably apertured shrouds or cages 62. In greater detail, as best seen in FIG. 5, the shaft 48 is in a horizontal position which supports the propellers 60 immediately above the lowest point in the V-bottom 46 of tank 32. This low point is preferably shaped to correspond to the path followed by the tips of propeller 60, thereby forming approximately a lower half of a shroud surrounding the propeller. The upper half of the shroud (shown in FIG. 5, but not FIG. 14) is here shown as being formed by an apertured member 62, which may be expanded metal, for example. In one embodiment, each of the openings in the member 62 was a diamond shape, about 1 ¾ inches high and ¾-inches wide. The total shroud width 63 in this embodiment was 6-inches. The shape of member 62 is such that it, in cooperation with the tank bottom 46, forms a shroud completely surrounding the propeller with a small clearance at the tips of the propeller blades.

Therefore, as the propeller blades rotate, they propel the slurry from the center of the tank, along the axis of shaft 48, and toward the opposite ends of the tank 32. Also, the centrifugal force of the rotating propellers fling the slurry through the apertures in shroud 62. These apertures interfere with this centrifugal motion sufficiently to baffle particle movement. Thus, there is great agitation within a cloud of particles, moving outwardly from shaft 48.

In this embodiment, a preferred eight shear blades 64 are fixed on and rotate with shaft 54. Again, the shear blades on one end of shaft 54 are pitched oppositely to the pitch of the shear blades on the other end of shaft 54. For example, the shear blades on the left may have a right-hand pitch and the shear blades on the right may have a left-hand pitch. The pitches of the propellers and of the shear blades should be in the opposite direction for the same relative positions in the tank, and they should overlap and interleave.

Figure 8:
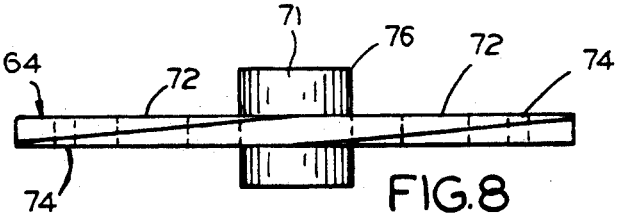
FIG. 8 is a side elevation view of the right-hand shear blade of FIG. 6, taken along line 8—8, thereof.
Figure 6:
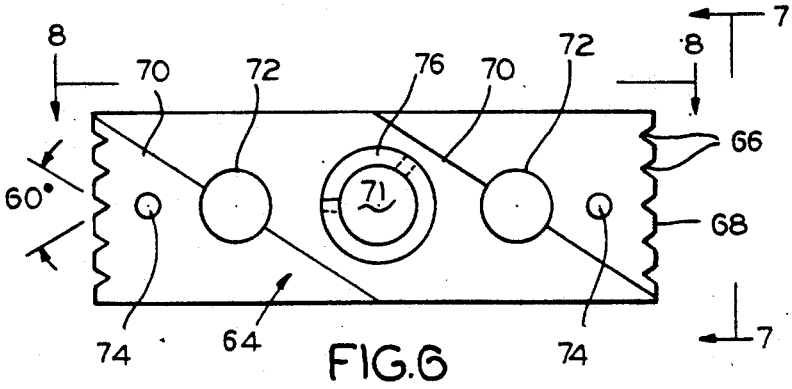
FIG. 6 is a plan view of a right-hand shear mixer blade.
Figure 7:
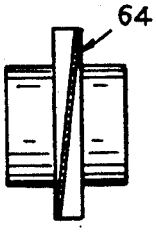
FIG. 7 is an end elevation view of the right-hand shear blade of FIG. 6, taken along line 7—7 thereof.

FIGS. 6–8 show the construction of the right-hand shear blade 64. In one embodiment, each blade is a flat strip or piece of steel, which is 15-inches long, ⅜-inches thick, and 5-inches wide. In this embodiment, five notches 66 are formed on each end of the blade, each notch having an equilateral triangular form, with a 60° angle at the apex. The lengths of the triangle base and of the lands 68 between the notches are approximately equal. The shear blade 64 is sharpened by being ground away from a diagonal line 70 toward the blade edge, as best seen in FIG. 7, thereby giving a propeller like pitch to the blade. The cutting edge of the blade is about ⅛-inch thick. The shear blade shaft 52 fits through a center hole 71.

A relatively large hole 72 is formed in the center of each side wing of the shear blade to provide a circular cutting edge. A relatively small hole 74 is also formed near the tip of each blade to receive an end of a spacer shaft. In one embodiment, the large hole is 1 ¾-inches in diameter and the small hole is ¼-inches in diameter. These holes decreased the batch by five minutes in one embodiment.

A collar 76 surrounds shaft hole 71 and is welded onto the shear blade 64 to provide a support by which the blade may be attached to the shaft 54.

Figure 11:
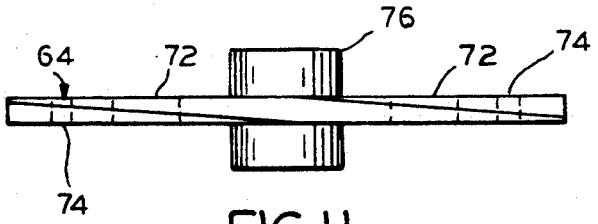
FIG. 11 is a side elevation of the left-hand shear blade of FIG. 9.
Figure 9:
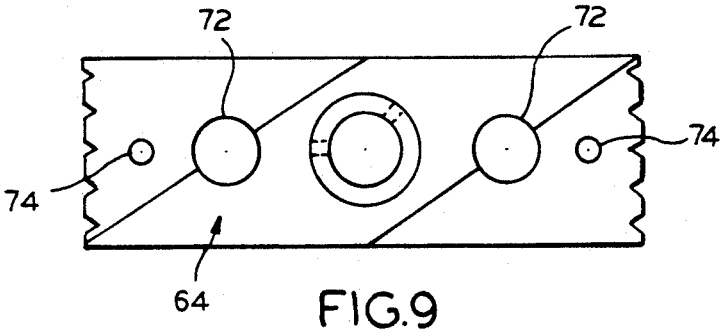
FIG. 9 is a plan view of a left-hand shear mixer blade.
Figure 10:
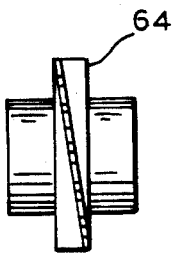
FIG. 10 is an end elevation view of the left-hand shear blade of FIG. 9.

FIGS. 9–11 show a left-hand shear blade which is the same as the right-hand shear blade of FIGS. 6–8 except that the blades are pitched in an opposite direction. This is best seen by comparing FIGS. 7 and 10.

Figure 12:
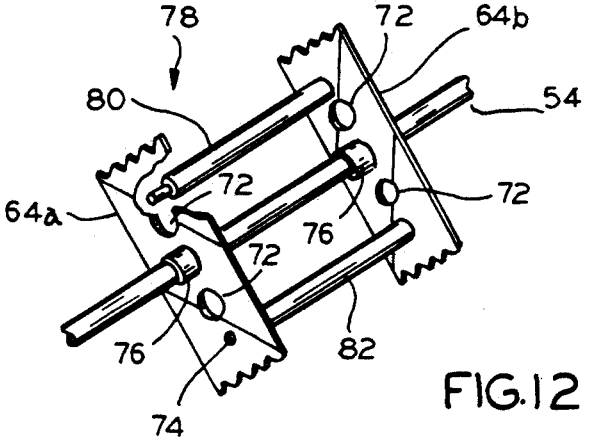
FIG. 12 is a perspective view of a pair of shear blades joined in a subassembly.

At two or more locations 78 (FIG. 4) on the shear blade shaft 52, the shear blades are ganged together, as best seen in FIG. 12 In greater detail, a pair of shear blades **64*a* and 64*b* are spaced apart by a distance equal to the length of a pair of spacer bars 80, 82, which fit into the small holes 74 in the shear blades. Thus, as the shaft 54 rotates, the spacer bars 80, 82 move through the slurry, beating it in the process. The spacer bars 80, 82** also break up any cloud of particles which tend to form.

Figure 13:
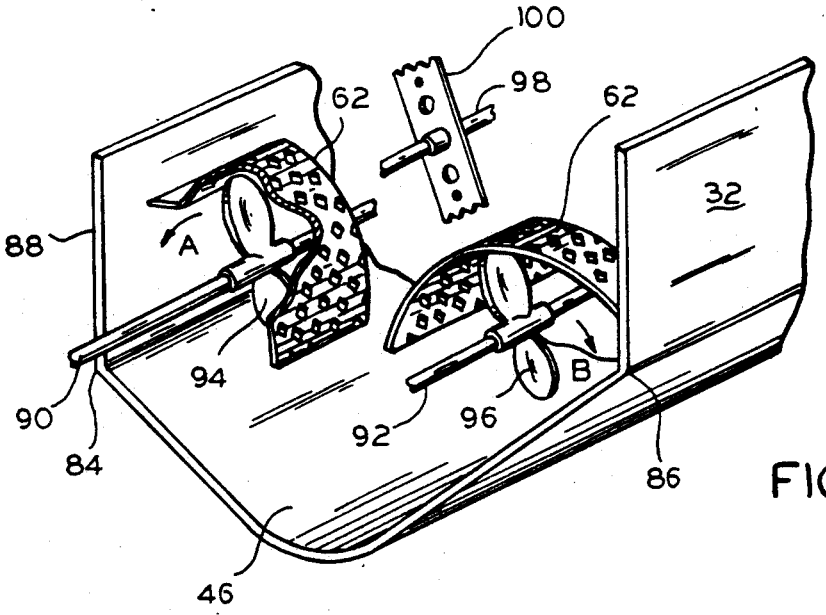
FIG. 13 is a perspective view, similar to FIG. 5, of a larger agitator tank having two propeller shafts and one shear blade shaft.

In order to make a larger capacity tank 88 (FIG. 13), a spaced parallel pair of counter rotating propeller shafts 90, 92 are mounted in the upper corners 84, 86 of the V-bottom 46. At least some of the propellers 94, 96 are surrounded by an apertured shroud 62 which is essentially the same as the shroud 62 of FIG. 5. As shown by arrows A, B, the propellers counterrotate in directions which fling the mixture toward the outside walls of the tank 32. The shear blade shaft 98 is centrally located above the propeller blades 90, 92.

In operation, the preferred starting material for both the gelatinized and raw material is corn starch, which is somewhat similar to the corn starch that is used in foods, except that the food quality of purity is not important in an absence of special requirements.

Starch is introduced to tempered water (110° F.) in tank 30. Then caustic is added with further heating of the mixture to 160° F. with steam or other means until gelatinization occurs. Next, the pump 38 operates for a predetermined period of time to charge tank 32 with a suitable amount of the carrier, the tank 32 having been previously charged with tempered water (85° F.), borax, and starch. In the prior art, the rate of adding materials was important. However, in the inventive structure, the charging of tank 32 should be as fast as conveniently possible.

The propellers 60 (FIG. 4) are rotated at 500 RPM and simultaneously, the shear blades 64 are rotated at 800 RPM until the starch bonding is completely broken, the particle sizes are greatly reduced, and particles of the combined carrier and raw materials take in water and swell. In general, it has been found that the inventive high speed mixer reduces the processing time by approximately one-half, delivering the adhesive at a rate of about 11–12 gallons/minute.

EXAMPLE #1

A. Primary Mixer 90 gallons of water was heated to 110 F with steam in primary mixer. 200 pounds of pearl corn starch was then added to the primary mixer. 34 pounds of caustic soda dissolved in 10 gallons of water was then introduced and the mixture was then heated to 155° F. causing the "carrier" molecules to swell. The reaction was allowed to complete swelling by mixing for 15 minutes. At this point 90 gallons of water was introduced to cool the carrier. A final 5 minute blending time was used to complete the "carrier".

B. High Shear Mixer 340 gallons of water was heated to 95° F. and 23 pounds of 5 mol borax was added. 1200 pounds of pearl corn starch was introduced to complete the slurry in the high shear mixer.

C. Final Mix

The carrier was pumped into the high shear mixer in 3 minutes and 45 seconds causing the viscosity to raise from 15 seconds (Stein-Hall) to approximately 180 seconds (Stein-Hall) and then mixed an additional eight (8) minutes in the high shear yielding a finished viscosity of 25 seconds (Stein-Hall) and gel point of 148° F. of pearl corn starch corrugated adhesive.

EXAMPLE #2

Another batch was made under the same conditions as example #1 except 20 pounds of pearl corn starch was subtracted from the high shear slurry and added to the primary mixer "carrier". The resulting finished adhesive yielded a viscosity of 44 seconds (Stein-Hall) and a gel point of 148° F. which was considered to be an optimum adhesive for glue unit applications.

EXAMPLE #3

Another batch was made under the same conditions as Example #1 except 21 pounds of 5 mol borax and 980 pounds pearl corn starch were added to the high shear mixer, and 220 pounds of pearl corn starch was used in preparing the "carrier". The resulting finished adhesive yielded a viscosity of 34 seconds (Stein-Hall) and a gel point of 148° F. which was considered optimum for single facer applications.

As with other adhesive making processes, the invention may substitute a chemical reaction for the cooking in the gelatinizer tank 30. For example, in tank 30, the starch may be mixed with a suitable material, such as sodium hydroxide, borax, or other materials which have also been used in the past. Since the source or origin of the carrier is unimportant to the invention, any suitable process may be used to produce the carrier.

Those who are skilled in the art will readily perceive how to modify the invention. Therefore, the appended claims are to be construed to cover all equivalent structures which fall within the true scope and spirit of the invention.

We claim:

1. A device for mixing starch adhesives and forming them into a paste, said device comprising a tank having a bottom configuration for enabling settlement into a specific area, means for introducing a liquid and at least raw starch and a carrier into said tank, said introduced liquid, raw starch, and carrier initially having a viscosity which is much higher than desired, a first elongated straight rotatable shaft extending longitudinally through said area, a plurality of propellers mounted on and affixed to turn with said first shaft, said propellers having a pitch which is primarily designed to move said liquid and starch, a second elongated straight rotatable shaft extending above and spaced parallel to said first shaft, and a plurality of high shear blades mounted on and affixed to turn with said second shaft, said shear blades being primarily designed to change the physical properties of said liquid and starch by applying a high shear stress to said liquid and starch and quickly breaking down said viscosity to said desired level, each of said shear blades comprising an elongated flat strip having a central mounting means for mounting on said shaft and separating said strip into two sidewings, said sidewings being shaped by thinning the sidewings with a taper in the thickness direction to give it a pitch, the tips of each of said sidewings having a series of notches formed therein to provide a plurality of shearing edges.

2. The device of claim 1 wherein each of said notches forms two sides of an equilateral triangle and said notches are separated from each other by lands having lengths approximately equal to the length of a side of said triangle.

3. The device of claim 2 wherein each of said notches forms two sides of an equilateral triangle and said notches are separated from each other by lands having lengths approximately equal to the length of a side of said triangle.

4. A device for mixing starch adhesives, said device comprising a tank having a bottom configuration for enabling settlement into a specific area, means for introducing a liquid and at least raw starch and a carrier into said tank, a first elongated straight rotatable shaft extending longitudinally through said area, a plurality of propellers mounted on and affixed to turn with said first shaft, said propellers having a pitch which is primarily designed to move said liquid and starch, a second elongated straight rotatable shaft extending above and spaced parallel to said first shaft, and a plurality of high shear blades mounted on and affixed to turn with said second shaft, said shear blades being primarily designed to change the physical properties of said liquid and starch by applying a high shear stress to said liquid and starch, each of said shear blades comprising an elongated flat strip having a central mounting means for mounting on said shaft and separating said strip into two sidewings, said sidewings being shaped by thinning the sidewings with a taper in the thickness direction to give it a pitch, the tips of each of said sidewings having a series of notches formed therein to provide a plurality of shearing edges.

5. The device of claim 4 wherein a relatively large hole is formed in approximately the center of each side wing of the shear blade.

6. The device of claim 4 wherein each of said notches forms two sides of an equilateral triangle and said notches are separated from each other by lands having lengths approximately equal to the length of a side of said triangle.

* * * * *